United States Patent [19]

Kumano et al.

[11] Patent Number: 4,792,510

[45] Date of Patent: Dec. 20, 1988

[54] ELECTROPHOTOGRAPHIC ELEMENT WITH SILICIDE TREATED POROUS $AL_2O_3$ SUBLAYER

[75] Inventors: Masafumi Kumano; Yasuyuki Shindoh, both of Sendai; Yutaka Sano, Kawasaki; Koichi Haga, Ohgawara; Akihiro Fuse, Shibata, all of Japan

[73] Assignees: Ricoh Co., Ltd., Tokyo; Ricoh Research Institute of General Electronics, Miyagi, both of Japan

[21] Appl. No.: 142,286

[22] Filed: Dec. 30, 1987

Related U.S. Application Data

[63] Continuation of Ser. No. 857,905, Apr. 30, 1986, abandoned.

[30] Foreign Application Priority Data

May 17, 1985 [JP] Japan ..... 60-106346
May 28, 1985 [JP] Japan ..... 60-114568

[51] Int. Cl.[4] ..... G03G 5/14; G03G 5/082
[52] U.S. Cl. ..... 430/65; 430/60
[58] Field of Search ..... 430/60, 65

[56] References Cited

U.S. PATENT DOCUMENTS 3,615,405 10/1971 Shebanow ..... 430/65 X
4,403,026 9/1983 Shimizu et al. ..... 430/65
4,416,962 11/1983 Shirai et al. ..... 430/65
4,457,971 7/1984 Caldwell et al. ..... 430/65 X

FOREIGN PATENT DOCUMENTS 2430115 1/1975 Fed. Rep. of Germany ..... 430/65
58-5749 1/1983 Japan ..... 430/65

*Primary Examiner*—Roland E. Martin
*Attorney, Agent, or Firm*—Flynn, Thiel, Boutell & Tanis

[57] ABSTRACT

This invention relates to a photosensitive material for electrophotography having, on a substrate, an amorphous silicon layer comprising silicon atom as the matrix and containing at least one of hydrogen atom, halogen atom and heavy hydrogen atom, characterized by provided with a porous aluminum oxide layer between said substrate and said amorphous silicon layer.

This invention further relates to a photosensitive material for electrophotography having, on a substrate, an amorphous silicon layer comprising silicon atom as the matrix and containing at least one of hydrogen atom, halogen atom and heavy hydrogen atom, characterized by provided with a porous aluminum oxide layer having the surface treated with a silicide material between said substrate and said amorphous silicon layer.

9 Claims, 2 Drawing Sheets

ELECTROPHOTOGRAPHIC ELEMENT WITH SILICIDE TREATED POROUS $AL_2O_3$ SUBLAYER

This application is a continuation of U.S. Ser. No. 857,905, filed Apr. 30, 1986, now abandoned.

BACKGROUND OF THE INVENTION (a) Field of the Invention

The present invention relates to a photosensitive material for electrophotography uses amorphous silicon as a photoconductive material. More particularly, the present invention relates to an amorphous silicon type photosensitive material for electrophotography having a specific aluminum oxide layer between a photoconductive layer and a substrate.

(b) Description of the Prior Art

Examples of photoconductive materials conventionally used in a photosensitive material for electrophotography include inorganic materials such as Se, ZnO and the like or organic materials such as poly-N-vinylcarbazole, trinitrofluorenone and the like. However, recently, amorphous silicon has attracted a good deal of attention as a photoconductive material. This is probably because a photosensitive material for electrophotography using amorphous silicon as a photoconductive layer has properties equivalent or superior to the other conventional materials. Furthermore, the amorphous silicon type photosensitive material is nonpoisonous to human and natural environments, and has very high durability.

However, the conventional amorphous silicon type photosensitive material has a disadvantage in that a deformation of layer occurs when an amorphous silicon layer is formed on a substrate, and the amorphous layer has problems such as embossing, exfoliation, cracking and the like since the adhesion between the substrate and the amorphous silicon layer is not satisfactory.

In order to solve these problems, the following methods (1) to (3) have been conventionally carried out. That is, (1) a method of improving the adhesion between a substrate and an amorphous silicon layer by providing a crystalline silicon layer between the substrate and the amorphous silicon layer (see Japanese Patent Laid Open No. 57-44154);

(2) a method of improving the adhesion between a substrate and an amorphous silicon layer by forming aluminum oxide containing water ($Al_2O_3$-$nH_2O$; n=1, 3) on the surface of the substrate (see Japanese Patent Laid Open No. 57-104938); and (3) a method of improving the adhesion between a substrate and an amorphous silicon layer by providing an auxiliary layer comprising nitrogen atoms between the amorphous silicon layer and the substrate.

However, the above mentioned methods (1) to (3) still have the following problems. That is, (1) according to the method (1), it is necessary to make the temperature of the substrate very high. Therefore, the substrate is damaged, and the properties as a photosensitive material for electrophotography are deteriorated since an atom constituting the substrate diffuses into the crystalline silicon layer;

(2) according to the method (2), the pores of an aluminum oxide layer are blocked with boiling water or pressurized water vapor in an autoclave, and therefore the anchor effect of the pore is not utilized for improving the adhesion, and in the same manner as in the method (1), the properties as a photosensitive material for electrophotography are deteriorated since the OH groups and oxygen atoms of water gradually diffuse into the amorphous silicon layer; and (3) according to the method (3), the auxiliary layer itself is hard, and exfoliation and embossing occur between the auxiliary layer and the substrate since the adhesion between the auxiliary layer and the substrate is not satisfactory.

SUMMARY OF THE INVENTION

An object of this invention is to provide a photosensitive material for electrophotography which can be produced by a relatively easy method and which has a high quality and high durability and is achieved by improving the adhesion between a substrate and an amorphous silicon layer.

That is, an object of this invention is to provide a photosensitive material for electrophotography, having on a substrate, an amorphous silicon layer comprising silicon atom as the matrix and containing at least one of hydrogen atoms, halogen atoms and heavy hydrogen atoms, characterized by a porous aluminum oxide layer positioned between said substrate and said amorphous silicon layer.

Another object of this invention is to provide a photosensitive material for electrophotography having, on a substrate, an amorphous silicon layer comprising silicon atoms as the matrix and containing at least one of hydrogen atoms, halogen atoms and heavy hydrogen atoms, characterized by being provided with a porous aluminum oxide layer having its surface treated with a silicide material between said substrate and said amorphous silicon layer.

DETAILED DESCRIPTION OF THE INVENTION

The present invention resides in a photosensitive material for electrophotography having, on a substrate, an amorphous silicon layer comprising silicon atoms as the matrix and containing at least one of hydrogen atoms, halogen atoms and heavy hydrogen atoms, characterized by being provided with a porous aluminum oxide layer positioned between said substrate and said amorphous silicon layer, the pores of which are not blocked.

The present invention further resides in a photosensitive material for electrophotography having, on a substrate, an amorphous silicon layer comprising silicon atoms as the matrix and containing at least one of hydrogen atoms, halogen atoms and heavy hydrogen atoms, characterized by being provided with a porous aluminum oxide layer, the surface of which is treated with a silicide material, between said substrate and said amorphous silicon layer.

As a result of a study concerning an amorphous silicon type photosensitive material for electrophotography, we have found that various desirable properties in respect to quality and durability can be retained for a long time by providing a non-treated porous aluminum oxide layer or a porous aluminum oxide layer having the surface treated with a silicide material between said substrate and said amorphous silicon layer.

The present invention is fully explained hereinafter in accordance with the accompanying drawings.

Figure 1:
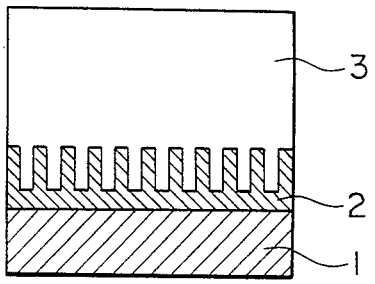
FIGS. 1, 2 and 3 are sectional views illustrating the various embodiments of a photosensitive material for electrophotography of the present invention.

FIG. 1 illustrates the basic structure of a photosensitive material for electrophotography of the present invention, wherein 1 indicates an electroconductive substrate; 2 indicates a porous aluminum oxide layer and 3 indicates an amorphous silicon layer.

Figure 2:
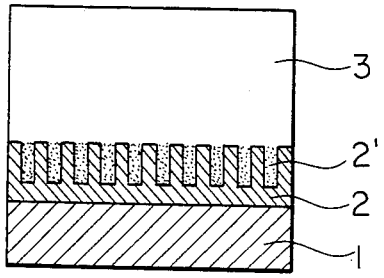

FIG. 2 illustrates another embodiment of a photosensitive material for electrophotography of the present invention, wherein 1 indicates an electroconductive substrate; 2 indicates a porous aluminum oxide layer treated with a silicide material; 2' indicates the silicide material; and 3 indicates an amorphous silicon layer.

Figure 3:
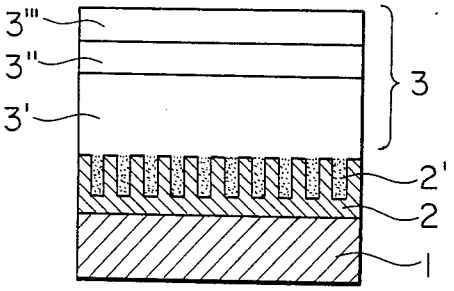

FIG. 3 illustrates still other embodiment of a photosensitive material for electrophotography of the present invention, wherein 1 indicates an electroconductive substrate; 2 indicates a porous aluminum oxide layer treated with a silicide material; 2' indicates the silicide material; 3 indicates an amorphous silicon layer comprising three layers 3', 3'' and 3'''; 3' and 3''' indicate amorphous silicon layers containing dopants and 3'' indicates an amorphous silicon layer containing no dopant.

The structure of the porous aluminum oxide layer used in the present invention and a method of forming thereof are illustrated hereinafter.

When electrolysis is conducted in an electrolytic bath using aluminum as an anode, an oxide film is formed on the aluminum. The oxide film thus formed includes a barrier type film and a porous type film (Alumite) depending on the type of the electrolytic bath used. The former film is formed in an acidic electrolytic bath, the power of chemically dissolving aluminum of which is weak, for example, boric acid/sodium borate aqueous solution, while the latter film is formed in an acidic electrolyte bath, the power of chemically dissolving aluminum of which is strong, for example, sulfuric acid aqueous solution. The oxide film structure of the porous type film (Alumite) is illustrated by "hexagonal column model", the pore size examples of which are illustrated in the following Table 1 (F. Keller, M. S. Hunter and D. L. Robinson; "J. Electrochem. Soc.", 100, 411, 1953).

TABLE 1

| Electrolyte | Temperature (°C.) | Pore Diameter(Å) | Wall Thickness (Å/V) |
|---|---|---|---|
| 4% $H_3PO_4$ | 23 | 330 | 10.0 |
| 2% Oxalic Acid | 24 | 170 | 9.7 |
| 3% Chromic Acid | 37 | 240 | 10.9 |
| 15% $H_2SO_4$ | 10 | 120 | 8.0 |

If the porous type film (Alumite film) is treated with water vapor or boiling water as mentioned in the conventional technique, a hydrate is formed on the surface of the film and pore wall as illustrated in the following reaction formula.

$$Al_2O_3 + H_2O \rightarrow Al_2O_3 — H_2O \text{ (boehmite)}$$

The hydrate thus formed blocks the pores. This hydrate is called as boehmite, and is formed at a temperature of 80° C. or higher.

According to the present invention, as can be seen from FIG. 1, a porous aluminum oxide layer 2, the pores of which are not blocked, is used as a buffer layer between a substrate 1 and an amorphous silicon layer 3.

A photosensitive material for electrophotography using a porous aluminum oxide layer 2, the pores of which are not blocked, in accordance with the present invention has the following advantages in comparison with the conventional photosensitive material for electrophotography using an aluminum oxide layer, the pores of which are blocked.

(a) The amount of $H_2O$ chemical-structually contained in the aluminum oxide layer 2 is very small since the presence of $H_2O$ is limited on the pore wall. Thus, the amount of $H_2O$ diffused to the amorphous silicon layer 3 as OH groups and oxygen atoms is substantially negligible. Therefore, the properties of the photosensitive material for electrophotography of the present invention are stable for a long term. Furthermore, the amount of $H_2O$ separated from the alminum oxide layer is very small even at a high temperature (stable at a temperature of 600° C. or lower), and consequently pinholes, cracks and the like by deformation do not occur.

(b) Amorphous silicon is invaded into the pores of the porous aluminum oxide layer, which achieves an anchor effect, thus notably improving the adhesion between the substrate 1 and the amorphous silicon layer 3. Judging from the above Table 1, the number of pores is large and consequently the anchor effect achieved is very strong.

According to another embodiment of the present invention, as can be seen from FIG. 2, a porous aluminum oxide layer 2, as mentioned above, is applied on a substrate 1, the pores of the porous aluminum oxide layer being treated with a silicide material 2'. Superfluous silicide material on the outside of the pores is removed by etching in order to expose the Alumite surface and an amorphous silicon layer 3 is further applied on the etched and exposed surface.

The photosensitive material for electrophotography thus prepared in accordance with the present invention has the following advantages in comparison with the conventional photosensitive material for electrophotography using aluminum oxide layer, the pores of which are blocked.

(a) In the same manner as in the above mentioned embodiment, the amount of $H_2O$ chemical-structually contained in the aluminum oxide layer 2 is very small since the presence of $H_2O$ is limited on the pore wall. Thus, the same effect as mentioned in the above embodiment can be achieved.

(b) The silicide material is invaded into the pores of the porous aluminum oxide layer, which achieves an anchor effect, thus notably improving the adhesion between the substrate 1 and the silicide material. Judging from the above Table 1, the number of pores is large and consequently the anchor effect achieved is very strong.

When aluminum is used as a metal for forming a silicide material, AlSi silicide is formed. Thus, since aluminum atom are commonly present in the aluminum oxide layer and the silicide material, a chemically bonding force is generated between the two, thereby notably improving the adhesion of the two.

(c) When applying a silicide material on the pores of a porous aluminum oxide layer and further depositing an amorphous silicon layer on the silicide material thus applied, a common atom, i.e. Si atom is present in the silicide material and the amorphous silicon layer since the silicide is an alloy of silicon and metal. Therefore, the adhesion between the silicide material and the amorphous silicon layer is highly improved and the matching of lattice constants in the interface therebetween becomes favorable, thus structural and electrical adhesion between the two are notably improved. Consequently, a density trap for photocarrier at the interface between the amorphous silicon layer and the substrate is reduced and electrophotographic properties are improved.

(d) Other various effects can be expected by appropriately selecting metals for a silicide material and for a substrate. For example, when the metal of the surface of a substrate is Al, Cr, Mo, Ti or the like and Pt is used for forming a silicide material, the light sensitivity of the electrophotographic properties is improved since the contact resistance at the junction interface becomes ohmic contact.

When the substrate is aluminum or an aluminum alloy and the silicide material is also aluminum, in addition to the improvement of the adhesion, Al acts as an acceptor and the silicide material becomes p-type in view of its electrical properties since the silicide material Al (belonging to Group III of the Periodic Table) has a semiconductive band gap. Therefore, the aluminum oxide layer, the surface of which is treated with the silicide material, acts also as a blocking layer for preventing the impregnation of free carriers from the substrate. Thus, the electrification potential properties are improved. For example, the maximum surface potential is increased and the dark decay is reduced.

An electroconductive substrate 1 used in the electrophotographic element or an aluminum alloy. A porous aluminum oxide layer 2 of a thickness of 0.1 μm to 2 μm is formed on the electroconductive substrate by an anodic oxidation method or the like.

The surface treatment with a silicide material is carried out by a sputtering process, alloy reaction method, chemical vapor deposition method or the like. The pores of a porous aluminum oxide layer are treated with a silicide material 2' and superfluous silicide is optionally removed by etching or some other method in order to expose the surface of the substrate (Alumite).

An amorphous silica layer 3 having a thickness of 1 to 100 μm, preferably 2 to 50 μm, is formed on the porous aluminum oxide layer 2 or the porous aluminum oxide layer, the surface of which is treated with a silicide material 2', by the known methods such as a glow discharge method, sputtering method, ion-plating method or the like.

The electrophotographic properties of a photosensitive material for electrophotography using amorphous silicon are determined by factors including the quality of a photosensitive layer deposited on a substrate and the state of the interface between the photosensitive layer and the substrate.

As mentioned above, if a porous aluminum oxide layer is provided on a substrate, the adhesion between the substrate and a photosensitive layer of any style of structure is improved because the photosensitive layer is deep-rooted in the pores of porous aluminum oxide layer. thus, cracks, exfoliations and the like between the two layers are prevented, and consequently a photosensitive material having stable properties are obtained.

When applying a silicide material in the pores of a porous aluminum oxide layer and further depositing an amorphous silicon layer on the silicide material thus applied, Si atom are present as a common atom between the silicide material and the amorphous silicon layer since the silicide is an alloy of silicon and metal. Therefore, not only the physical adhesion between the two is improved by the anchor effect, but also the matching of lattice constants at the interface therebetween becomes favorable, thus the electrical adhesion between the two is notably improved. Consequently, a trap density for trapping photocarrier at the interface between the photosensitive layer and the substrate is reduced and electrophotographic properties such as sensitivity are improved. Thus, a satisfactory photosensitive material for electrophotography, the residual potential of which is lowered, can be produced.

The amorphous silicon layer of the electrophotographic element of the present invention comprises silicon atom as the matrix and contains at least one of hydrogen atoms, halogen atoms and heavy hydrogen atoms. The amorphous silicon layer used in the present invention may optionally further contain at least one dopant selected from the group consisting of oxygen, Group III and Group V elements of the Periodic Table. The amorphous silicon layer may be one layer, or may comprise two or more layers, some of which may contain the above mentioned various dopants in various amounts. The surface of the amorphous silicon layer opposite to the substrate side may be provided with a protective layer.

The present invention can be applied to any conventionally known amorphous silicon type photosensitive material.

The present invention is further illustrated by the following Examples, but should not be limited thereto.

EXAMPLE 1

A photosensitive material for electrophotography was prepared by the following steps (i) to (xiii).

(i) The surface of a cylinder type electroconductive substrate using A 3003 aluminum (hereinafter referred to as "Al") as a starting material (hereinafter referred to as "Al drum") was treated by polishing, fully cleaning, dipping in a 10% NaOH aqueous solution at room temperature, further dipping in a 30% $HNO_3$ aqueous solution and degreasing.

Figure 4:
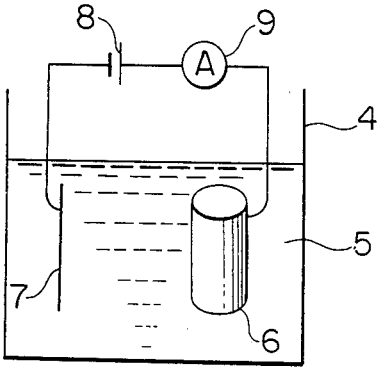
FIG. 4 illustrates an apparatus for applying Alumite-treatment on an aluminum drum in the production of a photosensitive material for electrophotography of the present invention.

(ii) As can be seen from FIG. 4, the above degreased Al drum 6 was dipped in an electrolyte 5 in a bath 4. 15% by weight $H_2SO_4$ aqueous solution was used as the electrolyte.

(iii) A cathode plate 7 having an area equivalent to or larger than that of the side wall of the Al drum 6 was dipped in the above electrolyte 5 in such a position as to be opposite to the Al drum. A Pt plate was used as the cathode plate 7.

(iv) The Al drum 6 and the cathode plate 7 were connected with an electric power source 8 in such a manner as to be respectively an anode and a cathode. A direct current power source was used as the electric power source 8.

(v) The Al drum 6 was anodized at room temperature for several minutes. This anodic oxidation was carried out by checking a galvanometer 9 and controlling the voltage of the power source 8 in such a manner as to constantly keep an electric current density at about 10 mA/cm². The electrolyte 5 was cooled and stirred since the oxidation of aluminum generates heat and gas. The stirring is necessary for obtaining a uniform oxidized film.

(vi) After the anodic oxidation, the Al drum was pulled up from the electrolyte 5, and was washed with flowing pure water for at least 10 minutes. It is necessary to fully wash the Al drum because various properties of a photosensitive material for electrophotography are degraded if the electrolyte remains in the pores of the anodized aluminum surface (Alumite).

(vii) After washing, the porous anodized aluminum layer (Alumite layer) formed on the surface of the Al drum was dried. The thickness of the Alumite layer was about 0.5 μm.

Figure 5:
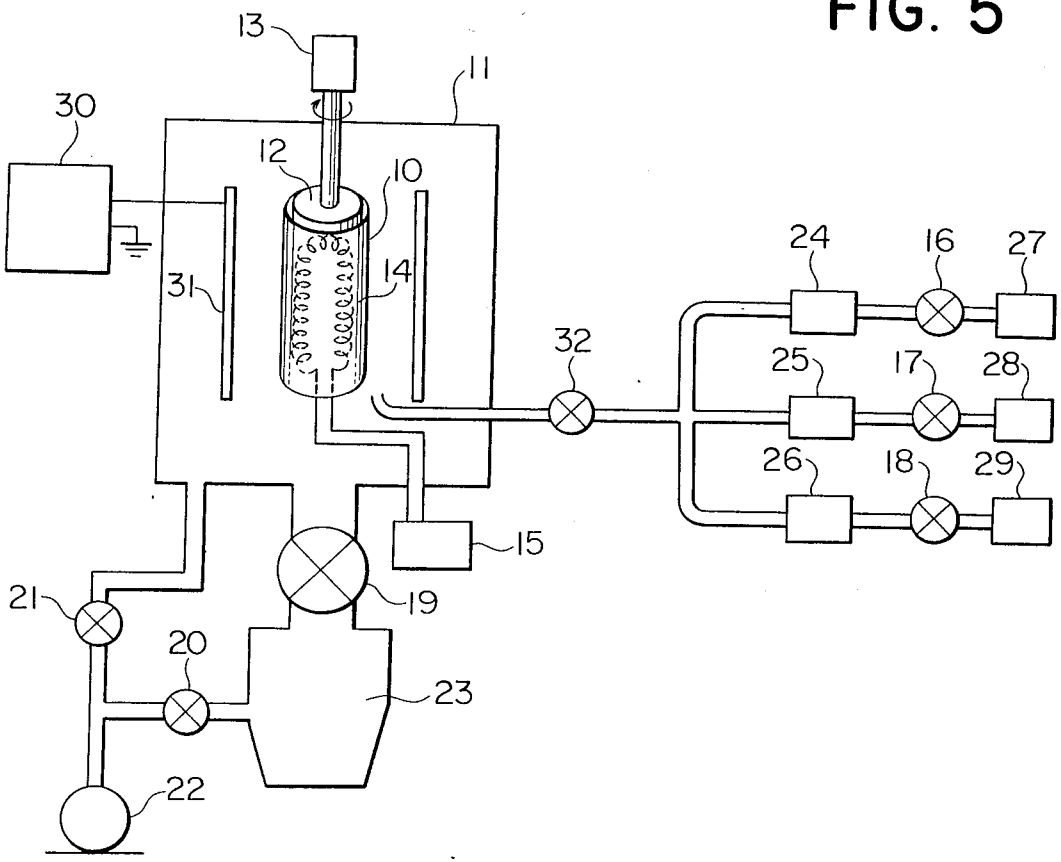
FIG. 5 illustrates a plasma CVD (chemical vapor deposit) apparatus for producing a photosensitive material for electrophotography of the present invention.

(viii) As can be seen from FIG. 5, the Al drum 10 having the porous anodized aluminum layer (Alumite layer) formed was fixed by a supporting means 12 in a hamber 11, and was rotated by a motor 13 for rotating a drum.

(ix) The drum was then heated at a constant drum surface temperature of 200° C. by using a heater 14 and a temperature controller 15.

(x) Air in the chamber 11 was evacuated by a rotary pump 22, while closing stopcocks 16, 17 and 18 for gas bombs, main valve 19 and a valve 20 and opening a roughly evacuating valve 21.

(xi) When the inside of the chamber 11 reached a predetermined degree of vacuum, the evacuation was further continued by an oil diffusion pump 23 while closing the roughly evacuating valve 21 and opening the valve 20 and the main valve 19.

(xii) When reaching a predetermined degree of vacuum, the main valve 19 was closed. Thereafter, respective gas components were controlled to predetermined flow amounts by opening the stopcocks 16, 17 and 18 for respective gas bombs 27, 28 and 29 while checking mass flowmeters 24, 25 and 26, and the respective gas components were introduced into the chamber by opening a valve 32.

The gas components used in this step are shown in the following Table 2.

TABLE 2

| | | |
|---|---|---|
| Gas Bomb 27 | $SiH_4$ | 20% (Ar base) |
| Gas Bomb 28 | $B_2H_6$ | 100 ppm (Ar base) |
| Gas Bomb 29 | $O_2$ | 100% |

(xiii) An amorphous silicon layer (containing hydrogen) was deposited on the surface of the above treated Al drum 10 by applying high frequency power from a high frequency electric power source 30 on an electrode 31 while keeping the degree of vacuum at 1 Torr and the drum surface temperature at 200°C. under the conditions as shown in the following Table 3.

TABLE 3

| | | | |
|---|---|---|---|
| Starting Material Gas and Flow Amount | $SiH_4$ | (20%)/Ar | 400 sccm |
| | $B_2H_6$ | (100 ppm)/Ar | 4 sccm |
| | $O_2$ | (100%) | 8 sccm |
| Pressure: | | 1 Torr | |
| High-frequency Output: | | 75 W | |
| Frequency: | | 13.56 MHz | |
| Drum Surface Temperature: | | 200° C. | |

The amorphous silicon layer 3 containing hydrogen (see FIG. 1) was deposited for about 6 hours, and the thickness of the amorphous silicon layer (containing hydrogen) thus deposited was about 20 μm.

The test for evaluating various properties of the photosensitive material for electrophotography as prepared above was carried out in the following manner. That is, an image-forming process was carried out by (a) applying positive corona discharge on the photosensitive material at 6 KV power source voltage in the dark, (b) subjecting to an image-exposure at 95 Lux light amount to form an electrostatic image, (c) developing the image with a toner having negative charge, and (d) transferring the developed image onto a plain paper. The above image-forming process was repeated, and the image developed on the first copy paper was compared with that developed on the 50,000th copy paper.

As the results of this, it was proved that there was no density difference between the two images, and that there was no poor image having white blur, ghost and other defects. The amorphous silicon layer (containing hydrogen) did not suffer from exfoliation, cracking and the like even after repeating the image-forming process.

In the above process, the sulfuric acid electrolyte bath for an Al drum 6 may be replaced by the other inorganic acid bath such as phosphoric acid bath, cromic acid bath or the like, or an organic acid bath such as oxalic acid bath, malonic acid bath or the like. The Pt cathode plate may also be replaced by carbon, stainless material or the like. In the above process, a direct current was used for the anodic oxidation, but an alternating current with bias, pulse or the like can also be used instead.

EXAMPLE 2

In the same manner as in the steps (i) to (vii) of Example 1, a porous anodized aluminum layer (Alumite layer) was formed on an Al drum. Thereafter, an amorphous silicon layer (containing hydrogen) was deposited by reactive sputtering process to a thickness of about 20 μm on the above formed porous aluminum oxide layer. The amorphous silicon layer (containing hydrogen) was formed under the following conditions as shown in the following Table 4.

TABLE 4

| | | | |
|---|---|---|---|
| Target: | polycrystalline high purity silicon (99.999%) | | |
| Starting Material Gas and Flow Amount | Ar | 100% | 30 sccm |
| | $H_2$ | 100% | 20 sccm |
| | $O_2$ | 100% | 6 sccm |
| Pressure: | | 0.01 Torr | |
| High-frequency Output: | | 100 W | |
| Drum Surface Temperature: | | 200° C. | |

The photosensitive material thus prepared was subjected to the same test as in Example 1, and it was proved that a satisfactory result was obtained in the same manner as in Example 1.

EXAMPLE 3

In the same manner as in the steps (i) to (vii) of Example 1, a porous anodized aluminum layer (Alumite layer) was formed on an Al drum 10. As can be seen from FIG. 5, the Al drum 10 having the above formed porous aluminum oxide layer was fixed by a supporting means 12 in a chamber 11, and the Al drum 10 was rotated by a motor 13 for rotating a drum.

The drum was then heated at a constant drum surface temperature of 250° C. by using a heater 14 and a temperature controller 15.

Air in the chamber 11 was evacuated by a rotary pump 22, while closing stopcocks 16, 17 and 18 for gas bombs, main valve 19 and a valve 20 and opening a roughly evacuating valve 21.

When the inside of the chamber 11 reached a predetermined degree of vacuum, the evacuation was further continued by an oil diffusion pump 23 while closing the rough-evacuating valve 21 and opening the valve 20 and the main valve 19.

When reaching a predetermined degree of vacuum, the main valve 19 was closed. Thereafter, a gas component was controlled to a predetermined flow amount by opening the stopcock 16 for a gas bomb 27 while checking a mass flowmeter 24, and the gas component was introduced into the chamber by opening a valve 32. The gas component used in this step was $SiH_4$ 20% (Ar base).

An amorphous silicon layer (containing hydrogen) was deposited on the surface of the above treated Al drum 10 by applying high frequency power from a high frequency electric power source 30 on an electrode 31 under the conditions as shown in the following Table 5 while keeping the drum surface temperature at 250° C. and the degree of vacuum at 1 Torr by closing the valve 20 and opening the valve 21.

TABLE 5

| | | |
|---|---|---|
| Starting Material Gas Flow Amount | $SiH_4$ (20%)/Ar | 400 sccm |
| Pressure: | 1 Torr | |
| High-frequency Output: | 75 W | |
| Frequency: | 13.56 MHz | |
| Drum Surface Temperature: | 250° C. | |

The amorphous silicon layer was deposited for about 20 seconds, and the substrate having the amorphous silicon layer deposited was taken out from the reaction chamber 11 to measure the thickness of the amorphous silicon layer thus deposited. As a result, it was proved that the thickness of the amorphous silicon layer was about 200 Å.

The substrate thus obtained was subjected to heat treatment for 120 minutes by keeping the substrate temperature at a temperature of 300°–600° C., thus forming a silicide (AlSi) on the substrate, which was prepared from Al of the Alumite layer and Si of the amorphous silicon layer. In order to expose the Alumite layer of the substrate, superfluous amorphous silicon film which was not converted to silicide (AlSi) was removed by etching, and the above formed silicide material 2' was left only in the pores of the Alumite layer (see FIG. 2).

On the substrate thus treated, an amorphous silicon layer 3 was further deposited by using a plasma CVD apparatus in the following manner.

As can be seen from FIG. 5, the Al drum 10 having the porous anodized aluminum layer (Alumite layer) treated with the silicide material as mentioned above, was fixed by a supporting means 12 in a chamber 11, and was rotated by a motor 13 for rotating a drum.

The drum was then heated at a constant drum surface temperature of 200° C. by using a heater 14 and a temperature controller 15.

Air in the chamber 11 was evacuated by a rotary pump 22, while closing stopcocks 16, 17 and 18 for gas bombs, main valve 19 and a valve 20 and opening a roughly evacuating valve 21.

When the inside of the chamber 11 reached a predetermined degree of vacuum, the evacuation was further continued by an oil diffusion pump 23 while closing the roughly evacuating valve 21 and opening the valve 20 and the main valve 19.

When reaching a predetermined degree of vacuum, the main valve 19 was closed. Thereafter, respective gas components were controlled to predetermined flow amounts by opening the stopcocks 16, 17 and 18 for respective gas bombs 27, 28 and 29 while checking mass flowmeters 24, 25 and 26, and the respective gas components were introduced into the chamber by opening a valve 32.

The gas components used in this step are shown in the following Table 6.

TABLE 6

| | |
|---|---|
| Gas Bomb 27 | $SiH_4$ 20% (Ar base) |
| Gas Bomb 28 | $B_2H_6$ 100 ppm (Ar base) |
| Gas Bomb 29 | $O_2$ 100% |

An amorphous silicon layer (containing hydrogen) was deposited on the surface of the above treated Al drum 10 by applying high frequency power from a high frequency electric power source 30 on an electrode 31 while keeping the drum surface temperature at 200° C. and the degree of vacuum at 1 Torr by closing the valve 20 and opening the valve 21 under the conditions as shown in the following Table 7.

TABLE 7

| | | |
|---|---|---|
| Starting Material Gas and Flow Amount | $SiH_4$ (20%)/Ar | 400 sccm |
| | $B_2H_6$ (100 ppm)/Ar | 4 sccm |
| | $O_2$ (100%) | 2 sccm |
| Pressure | 1 Torr | |
| High-frequency Output: | 75 W | |
| Frequency: | 13.56 MHz | |
| Drum Surface Temperature: | 200° C. | |

In the formation of this amorphous silicon layer 3, oxygen atoms or boron atoms may be incorporated in the layer in order to impart a high resistance to the layer. In this example, the amorphous silicon layer 3 was prepared by adding oxygen gas in a flow amount of 2 sccm. The amorphous silicon layer 3 (see FIG. 2) was deposited for about 6 hours, and the thickness of the amorphous silicon layer thus deposited was about 20 μm.

The photosensitive material thus prepared was subjected to the same test as in Example 1, and it was proved that a satisfactory result was obtained in the same manner as in Example 1.

The presence of the silicide material, i.e. an alloy of aluminum and Si, between the substrate and the photosensitive material (as illustrated by FIG. 2) improves the matching of lattice constant and electrical adhesion at the interface between the two. Accordingly, the invasion of carriers from the substrate side can be prevented, while the transfer of photocarriers to the substrate side becomes easy. These phenomena bring favourable electrophotographic properties. For example, in addition to the improvement of the adhesion between a photosensitive layer and a substrate, sensitivity is improved and the residual potential is lowered.

A comparative test concerning electrophotographic properties was made with regard to two types of photosensitive materials with silicide treatment and without silicide treatment. The test results are shown in the following Table.

| | Maximum Surface Potential (V) | Sensitivity (sec) | Residual Potential (V) |
|---|---|---|---|
| Alumite Layer | 570 | 4.82 | 0 |

-continued

| | | | |
|---|---|---|---|
| treated with Silicide | | | |
| Alumite Layer alone | 575 | 5.36 | 8 |

| | |
|---|---|
| Measurement Conditions: | |
| Corona Charging Voltage: | 6 KV |
| Exposing Lamp Output: | 30 $\mu W/cm^2$ |
| Sensitivity: | Time required for the reduction of the surface potential from 400 V to 100 V |

EXAMPLE 4

A porous anodized aluminum layer (Alumite layer) was formed on an Al drum in the same manner as in the steps (i) to (vii) of Example 1, and the anodized Al drum was treated with a silicide material in the same manner as in Example 3.

A photosensitive layer comprising three layers was further deposited on the above treated Al drum in accordance with the following steps.

(i) As can be seen from FIG. 5, the Al drum 10 having the porous anodized aluminum layer (Alumite layer) formed was fixed by a supporting means 12 in a chamber 11, and was rotated by a motor 13 for rotating a drum.

(ii) The drum was then heated at a constant drum surface temperature of 200° C. by using a heater 14 and a temperature controller 15.

(iii) Air in the chamber 11 was evacuated by a rotary pump 22, while closing stopcocks 16, 17 and 18 for gas bombs, main valve 19 and a valve 20 and opening a roughly evacuating valve 21.

(iv) When the inside of the chamber 11 reached a predetermined degree of vacuum, the evacuation was further continued by an oil diffusion pump 23 while closing the roughly evacuating valve 21 and opening the valve 20 and the main valve 19.

(v) When reaching a predetermined degree of vacuum, the main valve 19 was closed. Thereafter, respective gas components were controlled to predetermined flow amounts by opening the stopcocks 16, 17 and 18 for respective gas bombs 27, 28 and 29 while checking mass flowmeters 24, 25 and 26, and the respective gas components were introduced into the chamber by opening a valve 32.

The gas components used in this step are shown in the following Table 8.

TABLE 8

| | |
|---|---|
| Gas Bomb 27 | $SiH_4$ 20% (Ar base) |
| Gas Bomb 28 | $B_2H_6$ 100 ppm (Ar base) |
| Gas Bomb 29 | $O_2$ 100% |

(vi) An amorphous silicon layer 3' (see FIG. 3) was deposited on the surface of the above treated Al drum 10 for 5 hours 40 minutes by applying high frequency power from a high frequency electric power source 30 on an electrode 31 while keeping the degree of vacuum at 1 Torr and the drum surface temperature at 200° C. under the conditions as shown in the following Table 9.

TABLE 9

| | | |
|---|---|---|
| Starting Material Gas and Flow Amount | $SiH_4$ (20%)/Ar | 400 sccm |
| | $B_2H_6$ (100 ppm)/Ar | 4 sccm |
| | $O_2$ (100%) | 8 sccm |
| Pressure: | 1 Torr | |

TABLE 9-continued

| | |
|---|---|
| High-frequency Output: | 75 W |
| Frequency: | 13.56 MHz |
| Drum Surface Temperature: | 200° C. |

(vii) After turning the high frequency power off and closing the stopcocks 17 and 18, $B_2H_6$ gas and $O_2$ gas were evacuated from the chamber 11 by the rotary pump 22 for a sufficient time. Thereafter, an amorphous silicon layer containing no dopant 3'' (see FIG. 3) was further deposited on the first amorphous silicon layer 3' for 18 minutes in accordance with the glow discharge method while keeping the pressure in the chamber 11 at 1 Torr and turning the high frequency power on at 75W. The thickness of the second amorphous silicon layer 3'' thus deposited was about 1 $\mu$m.

(viii) After turning the high frequency power off and opening the stopcocks 17 and 18, respective gases were introduced into the chamber 11 while controlling their flow amounts as shown in the above Table 9 by checking mass flow meters 24, 25 and 26. Thereafter, an amorphous silicon layer 3''' (see FIG. 3) was further deposited on the second amorphous silicon layer 3'' for 5 minutes by applying the high frequency power at 75W in accordance with the glow discharge method while keeping the degree of vacuum at 1 Torr and the drum surface temperature at 200° C. The thickness of the third amorphous silicon layer 3''' thus deposited was about 2500 Å.

Figure 6:
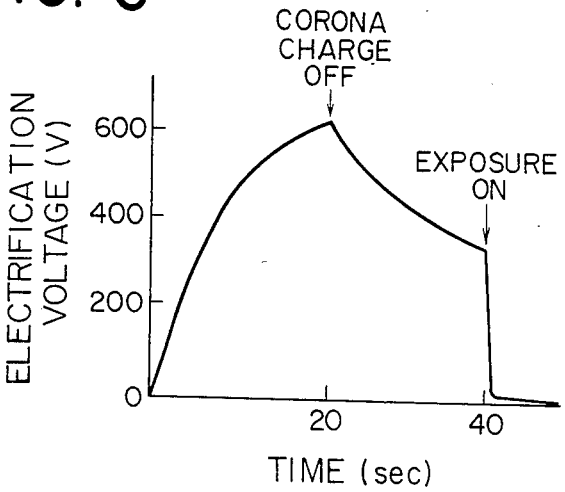
FIG. 6 illustrates the electrical properties of the electrophotographic photosensitive material prepared in Example 4.

(ix) Electrical properties of the photosensitive material thus prepared were measured and the results are shown in FIG. 6.

The photosensitive material thus prepared was subjected to the same test as in Example 1, and it was proved that a satisfactory result was obtained in the same manner as in Example 1.

As can be seen from Examples and the above description, the present invention provides a highly reliable photosensitive material for electrophotography having high quality and durability.

What we claim is:

1. A photosensitive material for electrophotography having, on a substrate, an amorphous silicon layer comprising silicon atoms as the matrix and containing at least one of hydrogen atoms, halogen atoms and heavy hydrogen atoms, and being characterized by being provided with a porous aluminum oxide layer positioned between said substrate and said amorphous silicon layer, said porous aluminum oxide layer having its surface treated with a silicide material.

2. A photosensitive material for electrophotography as claimed in claim 1, wherein said amorphous silicon layer further contains at least one dopant selected from the group consisting of oxygen, Group III and Group V elements of the Periodic Table.

3. A photosensitive material for electrophotography as claimed in claim 1, wherein said silicide material is Al silicide or Pt silicide.

4. A photosensitive material for electrophotography as claimed in claim 1, wherein said substrate is selected from the group consisting of aluminum, aluminum alloy, chromium, molybdenum and titanium.

5. A photosensitive material for electrophotography as claimed in claim 1, wherein said porous aluminum oxide layer has a thickness of 0.1 $\mu$m–2 $\mu$m and said amorphous silicon layer has a thickness of 1 $\mu$m–100 $\mu$m.

6. A photosensitive material for electrophotography as claimed in claim 5, wherein said amorphous silicon layer has a thickness of 2 μm–50 μm.

7. A photosensitive material for electrophotography as claimed in claim 1, wherein said amorphous silicon layer comprises two or more layers.

8. A photosensitive material for electrophotography as claimed in claim 7, wherein at least one of said amorphous silicon layers contains at least one dopant selected from the group consisting of oxygen, Group III and Group V elements of the Periodic Table.

9. A photosensitive material for electrophotography as claimed in claim 8, wherein said amorphous silicon layer comprises three layers, the first and the third layers of which contain at least one dopant selected from the group consisting of oxygen, Group III and Group V elements of the Periodic Table.

* * * * *